US011232892B2

(12) United States Patent
Shiota et al.

(10) Patent No.: US 11,232,892 B2
(45) Date of Patent: Jan. 25, 2022

(54) COIL AND METHOD FOR MANUFACTURING COIL

(71) Applicant: TOSHIBA INDUSTRIAL PRODUCTS AND SERVICES CORP., Kawasaki (JP)

(72) Inventors: Hiromu Shiota, Mie (JP); Eiji Shimomura, Mie (JP); Keishi Ito, Mie (JP); Hiroshi Goto, Mie (JP); Teruhiko Maeda, Mie (JP); Yuusuke Shima, Mie (JP)

(73) Assignee: TOSHIBA INDUSTRIAL PRODUCTS AND SYSTEMS CORP., Kawasaki (JP)

( * ) Notice: Subject to any disclaimer, the term of this patent is extended or adjusted under 35 U.S.C. 154(b) by 698 days.

(21) Appl. No.: 16/119,868

(22) Filed: Aug. 31, 2018

(65) Prior Publication Data

US 2019/0019606 A1 Jan. 17, 2019

Related U.S. Application Data

(63) Continuation of application No. PCT/JP2016/071880, filed on Jul. 26, 2016.

(30) Foreign Application Priority Data

Mar. 2, 2016 (JP) ..... JP2016-039983
May 24, 2016 (JP) ..... JP2016-103315

(51) Int. Cl.

| | |
|---|---|
| ***H01F 27/28*** | (2006.01) |
| ***H01F 5/06*** | (2006.01) |
| ***H01F 41/12*** | (2006.01) |
| ***H01F 5/02*** | (2006.01) |
| ***H01F 27/32*** | (2006.01) |

(52) U.S. Cl.

CPC ..... *H01F 5/06* (2013.01); *H01F 5/02* (2013.01); *H01F 27/2823* (2013.01); *H01F 27/327* (2013.01); *H01F 41/12* (2013.01)

(58) Field of Classification Search

CPC ..... H01F 27/2823; H01F 27/327; H01F 5/06; H01F 41/12
USPC ..... 336/186
See application file for complete search history.

(56) References Cited

U.S. PATENT DOCUMENTS

2012/0092108 A1 4/2012 Prabhakaran et al.
2014/0353000 A1* 12/2014 Yin ..... H01B 3/04 174/113 R

FOREIGN PATENT DOCUMENTS

| | | |
|---|---|---|
| CN | 1729605 | 2/2006 |
| CN | 101154848 | 4/2008 |
| JP | S 56-126807 | 9/1981 |
| JP | 2000-090747 | 3/2000 |
| JP | 2012-089838 | 5/2012 |

(Continued)

OTHER PUBLICATIONS

English translation of JP358057711 (Year: 1983).*

(Continued)

*Primary Examiner* — Ronald Hinson
(74) *Attorney, Agent, or Firm* — DLA Piper LLP US

(57) ABSTRACT

A coil of an embodiment is formed by winding a winding conductor in which a conductive conductor is molded by a resin, wherein the winding conductor has the resin filled to a surface of the conductor without leaving any spaces.

3 Claims, 9 Drawing Sheets

(56) References Cited

FOREIGN PATENT DOCUMENTS

JP 2013-206943 10/2013

OTHER PUBLICATIONS

Office Action in Japanese Application No. 2016-103315 dated Aug. 6, 2019.
Chinese Office Action in CN Application No. 201680081774.6, dated Jun. 23, 2020.
International Search Report in PCT/JP2016/071880 dated Oct. 18, 2018.
Written Opinion in PCT/JP2016/071880 dated Oct. 18, 2018.
English language abstract of JP 2012-089838 date May 10, 2012.
English language abstract of JP 2013-206943 dated Oct. 7, 2013.
English language abstract ofJP 2000-090747 dated Mar. 31, 2000.
English language abstract of JPS 56-126807 dated Sep. 26, 1981.

* cited by examiner

COIL AND METHOD FOR MANUFACTURING COIL

CROSS-REFERENCE TO RELATED APPLICATION(S)

This application is a continuation to an International Application No. PCT/JP2016/071880, filed on Jul. 26, 2016 which is based upon and claims the benefit of priority from Japanese Patent Application No. 2016-039983, filed on, Mar. 2, 2016 and Japanese Patent Application No. 2016-103315, filed on, May 24, 2016 the entire contents of which are incorporated herein by reference.

TECHNICAL FIELD

The present disclosure relates to a coil and a method of manufacturing a coil.

BACKGROUND ART

A coil is formed for example by winding a litz wire obtained by intertwining a plurality of enamel strands (thin wires) or winding a conductor such as a lower half rectangular wire having a rectangular cross section or a round wire having a circular cross section. The periphery of the conductor and the outer periphery of the coil are covered by a resin.

PRIOR ART DOCUMENT

Patent Document

Patent Document 1: Japanese Patent Application Publication No. 2000-90747 A

SUMMARY OF INVENTION

Problem Solved by Invention

However, degradation of the insulation property of conductors and coils lead to reduction in the performance of the coils.

Thus, there is provided a coil exhibiting excellent insulation property and a method of manufacturing such coil.

Solution to Problem

A coil of an embodiment is formed by winding a winding conductor in which a conductive conductor is molded by a resin, wherein the winding conductor has the resin filled to a surface of the conductor without leaving any spaces.

EMBODIMENTS OF INVENTION

First Embodiment

A first embodiment will be described hereinafter based on the drawings. Elements that are substantially identical in the description of the embodiments are identified with identical reference symbols and are not re-described.

A litz wire used in a coil comprises a multiconductor magnet wire (winding conductor) formed by intertwining a plurality of enamel strands (thin wire). The litz wire is being widely used as a magnet wire for coils used in high-frequency electric appliances. As the frequency of current conducted through the litz wire becomes greater, the loss becomes greater due to the increase in AC resistance caused by the skin effect.

The litz wire is used in the coils of high frequency electric appliances to suppress the increase of AC resistance by fragmenting the skin current by dividing the conductor into multiple wires using enamel lines having an insulation coating. A round litz wire having a circular cross section is generally used however, a rectangular litz wire having a rectangular cross section is also used to increase the coil occupancy when the coils of the electrical appliance are wound.

Thus, there is provided a coil having excellent insulation property and a method of manufacturing such coil.

Figure 1:
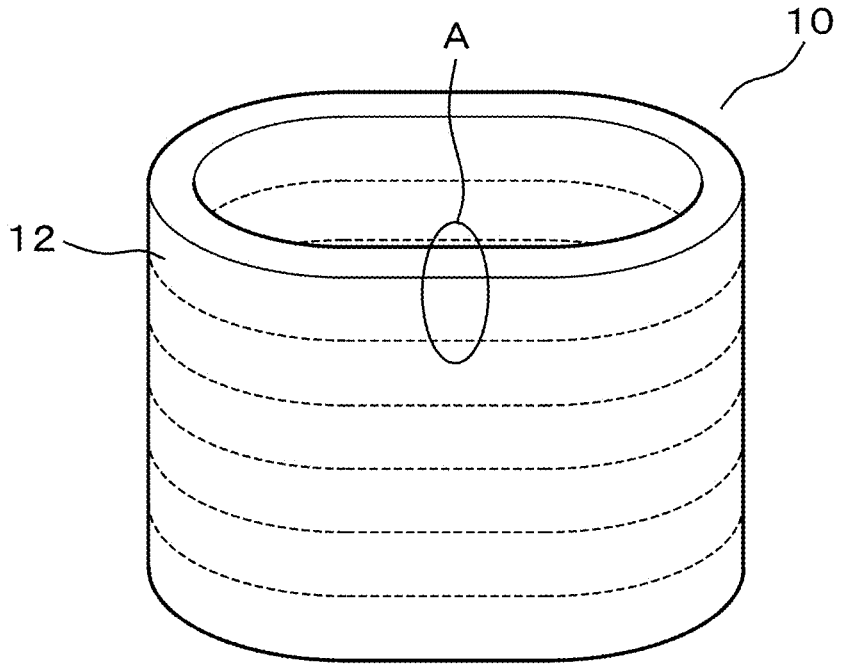
FIG. 1 is a diagram schematically illustrating an exemplary structure of a coil according to a first embodiment.
Figure 2:
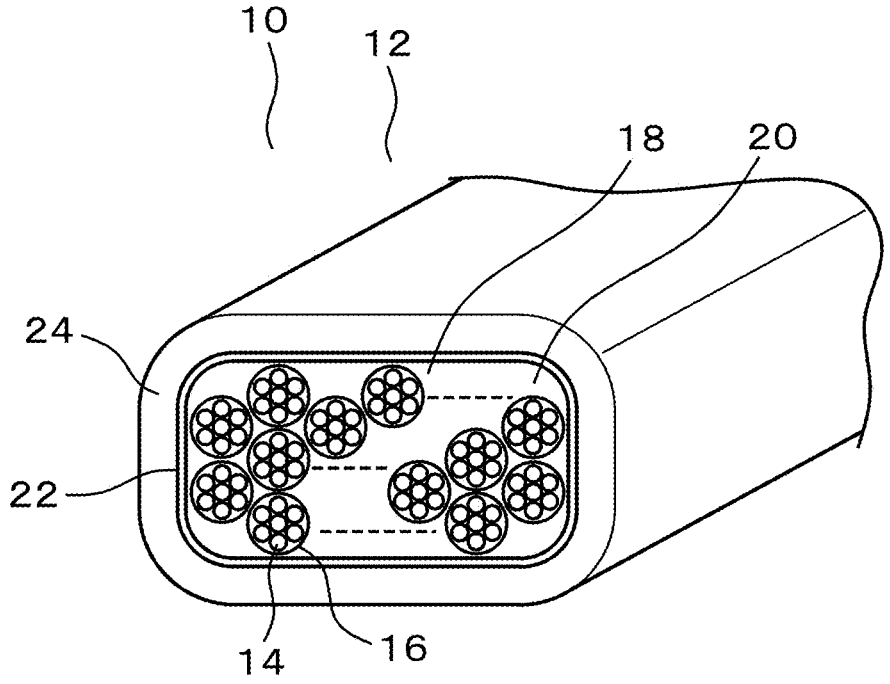
FIG. 2 is a diagram illustrating the cross sectional structure of the coil.

FIG. 1 is a perspective view schematically illustrating an exemplary structure of a coil 10 indicated as one example of an embodiment. FIG. 2 is a cross sectional view illustrating the structure at portion A of the coil 10 of FIG. 1. Coil 10 is configured by a litz wire 12 being a wiring conductor obtained by intertwining and bundling thin wires, that is, strands made of copper for example. The coil 10 is configured by tightly winding the litz wire in a whorl so as to form concentric ellipses having a cavity at the center with the entire structure being hardened by a resin. The portion A in FIG. 1 corresponds to a basic unit of the litz wire 12 and FIG. 2 illustrates the basic structure of the litz wire 12 constituting the coil 10. The litz wire 12 used in the coil 10 is a multiconductor magnet wire (winding conductor) obtained by intertwining and bundling a plurality of mutually insulated conductive strands 14 (thin wires) such as enamel lines provided with insulation coating for example.

As shown in FIG. 2, the litz wire 12 includes a first unit litz wire 16 obtained by intertwining a plurality of strands 14. Further, a second unit litz wire 18 is formed by intertwining a plurality of first unit litz wires 16. The litz wire 12 is formed by covering the periphery of the second unit litz wires 18 with a lashing band 22 and a surrounding band 24.

A strong aramid fiber tape for example is used as the lashing band 22. The lashing band 22 is shaped like a paper tape and is wound around the second unit litz wires 18 to lash the first unit litz wires 16 or the strands 14 constituting the second unit litz wires 18 so that they are not disassembled. The lashing band 22 is wound around the second unit litz wires 18 so that gaps G are formed between the wound lashing bands 22 as shown in the later described FIG. 4 (*a*).

The surrounding band 24 is wound around and covers the second unit litz wires 18 lashed by the lashing band 22. The surrounding band 24 is formed by hardening a later described nonwoven tape 32 impregnated with a later described resin liquid 38. In this case, the nonwoven tape 32 is raised as one example of a material capable of allowing penetration and permeation of the later described resin liquid 38 and capable of being wound around the second unit litz wires 18 during the later described manufacturing process flow of the coil 10. The material constituting the surrounding band 24 is not limited to the nonwoven tape 32 as long as the material possesses these properties.

In the second unit litz wires 18, insulative hardened resin 20 (resin) exists without leaving any spaces between the plurality of strands 14 or the plurality of first unit litz wires 16. The hardened resin 20 exists without leaving any spaces between the strands 14, the lashing band 22, and the surrounding band 24 and further between the first unit litz wires 16, the lashing band 22, and the surrounding band 24. That is, the second unit litz wire 18 is formed by hardening and integrally solidifying the plurality of strands 14 or the plurality of first unit litz wires 16 with the later described resin liquid 38 and is three dimensionally integrated and solidified by the hardened resin 20. Further, the litz wire 12 is obtained by solidifying the strands 14, the first unit litz wires 16, the second unit litz wires 18, the lashing band 22, and the surrounding band 24 with the hardened resin 20 without leaving any spaces. That is, the coil 10 and the litz wire 12 that constitutes the coil 10 are configured by filling and molding the hardened resin 20 between the strands 14 and in the periphery of the strands 14 without leaving any spaces.

A resin with high thermal conductivity, that is, with high heat dissipating property may be employed as the hardened resin 20, that is, the later described resin liquid 38. A resin obtained by adding a micro-sized and highly thermal conductive filler such as alumina or boron nitride to an epoxy resin for example as an additive that imparts high thermal conductivity is used as a resin having high thermal conductivity. When a resin with high thermal conductivity is employed, the coil 10 and the litz wire 12 constituting the coil 10 are configured so that hardened resin 20 with high thermal conductivity, that is, high heat dissipating property is filled between the plurality of strands 14, between the plurality of first unit litz wires 16, between the strands 14, lashing band 22, and the surrounding band 24, and further between the first unit litz wires 16, the lashing band 22, and the surrounding band 24 without leaving any spaces. Thus, because the interior of the formed coil 10 and the litz wire 12 constituting the coil 10 are filled with the hardened resin 20 having high thermal conductivity and high heat dissipating property without leaving any spaces and their outer periphery are covered by the surrounding band 24 hardened by the hardened resin 20 having high heat dissipating property, the coil 10 as a whole is caused to have high thermal conductivity and high heat dissipating property.

Figure 3:
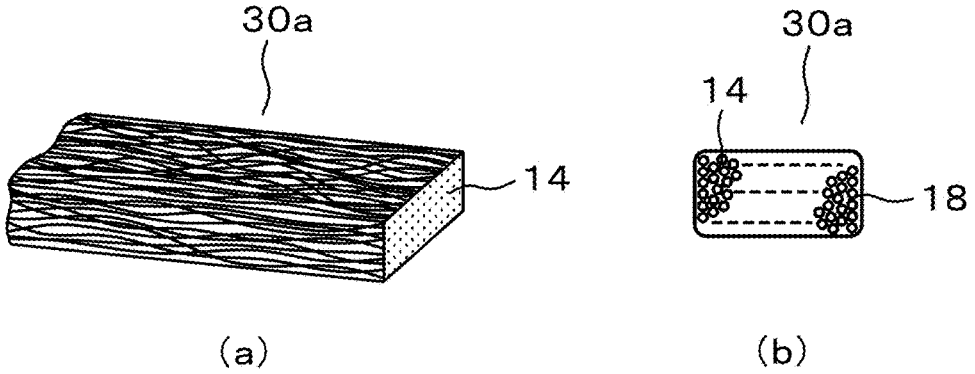
FIG. 3 is a diagram illustrating one phase of the manufacturing process flow of the coil.
Figure 4:
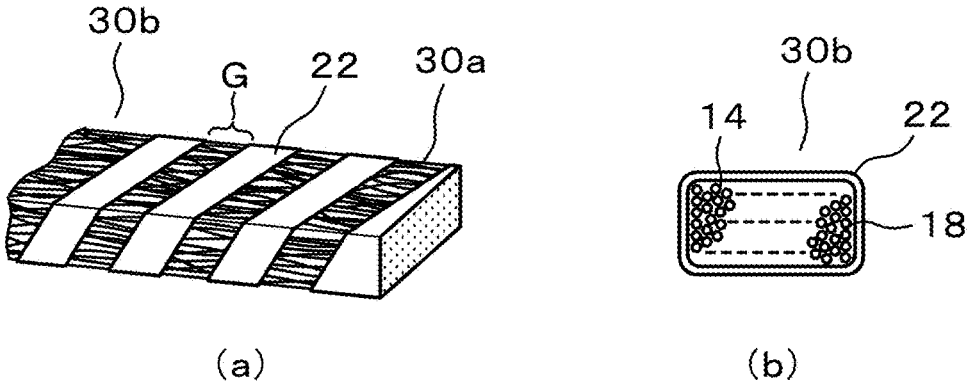
FIG. 4 is a diagram illustrating one phase of the manufacturing process flow of the coil.
Figure 5:
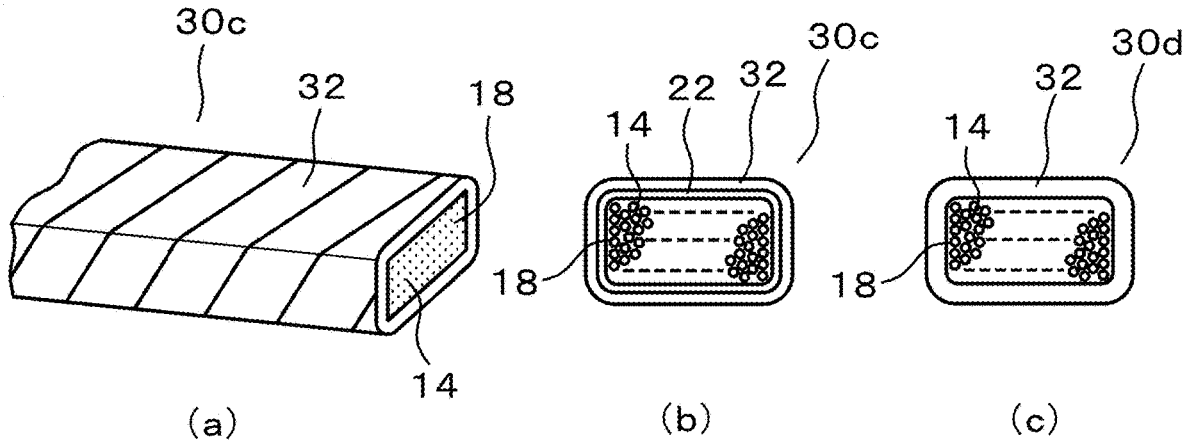
FIG. 5 is a diagram illustrating one phase of the manufacturing process flow of the coil.

Next, a description will be given on a method of manufacturing the coil 10. FIGS. 3 to 9 are figures for explaining the manufacturing method of the coil 10 and each illustrate one phase of the manufacturing process flow. FIG. 3 illustrates one phase of the manufacturing process flow of the litz wire 12 constituting the coil 10 and FIG. 3 (*a*) is a perspective view and FIG. 3 (*b*) is a cross sectional view. FIG. 4 illustrates one phase of the manufacturing process flow of the litz wire 12 constituting the coil 10 and FIG. 4 (*a*) is a perspective view and FIG. 4 (*b*) is a cross sectional view. FIG. 5 illustrates one phase of the manufacturing process flow of the litz wire 12 constituting the coil 10 and FIG. 5 (*a*) is a perspective view and FIGS. 5 (*b*) and 5 (*c*) are cross sectional views.

First, an intertwined litz wire 30*a* (litz wire) is prepared as shown in FIGS. 3 (*a*) and 3 (*b*). The intertwined litz wire 30*a* is formed by forming the first unit litz wires 16 by intertwining the strands 14 and thereafter intertwining the first unit litz wires 16. The intertwined litz wire 30*a* hardened by the hardened resin 20 corresponds to the second unit litz wire 18.

Next, as shown in FIGS. 4 (*a*) and 4 (*b*), the intertwined litz wire 30*a* is lashed by winding the lashing band 22 around the intertwined litz wire 30*a* to form a lashed litz wire 30*b* (litz wire). The lashing band 22 is wound around the intertwined litz wire 30*a* so as to form gaps, that is, spaces. In this state, the intertwined litz wire 30*a* is exposed from the gaps of the wound lashing band 22. The lashing band 22 is an aramid paper tape for example and thus, does not allow permeation of the later described resin liquid.

Next, as shown in FIGS. 5 (*a*) and 5 (*b*), the nonwoven tape 32 is wound around the lashed litz wire 30*b* to form a surrounded litz wire 30*c* (litz wire). In this case, the nonwoven tape 32 is wound around the lashed litz wire 30*b* so as not to form any gaps between the wound nonwoven tapes 32. The nonwoven tape 32 allows penetration and permeation of the later described resin liquid 38.

The nonwoven tape 32 includes a hardening accelerator of the later described resin liquid 38. Amines, imidazoles, phosphine, DBU (1,8-diazabicyclo[5.4.0]undec-7-ene) and its organic acid salt, ammonium or phosphonium compound or the like are used as the hardening accelerator.

In case the nonwoven tape 32 is strong enough to lash the intertwined litz wire 30*a*, that is, strong enough to prevent the strands 14 and the first unit litz wires 16 from disassembling, it is possible to omit the lashing of the intertwined litz wire 30*a* by the lashing band 22. That is, it is possible to form the surrounded litz wire 30*d* (litz wire) shown in FIG. 5 (*c*) by winding the nonwoven tape 32 around the intertwined litz wire 30*a* without leaving any spaces as shown in FIGS. 3 (*a*) and 3 (*b*). In this case, it is possible to omit the lashing by the lashing band 22 and thus, simplifies the process flow to contribute in reduction of manufacturing cost. Further, in the coil 10 and the litz wire 12 constituting the coil 10 in this case, the surrounding band 24 is wound around the second unit litz wires 18 and the lashing band 22 does not exist between the second unit litz wires 18 and the surrounding band 24. The remaining structures are the same.

Figure 6:
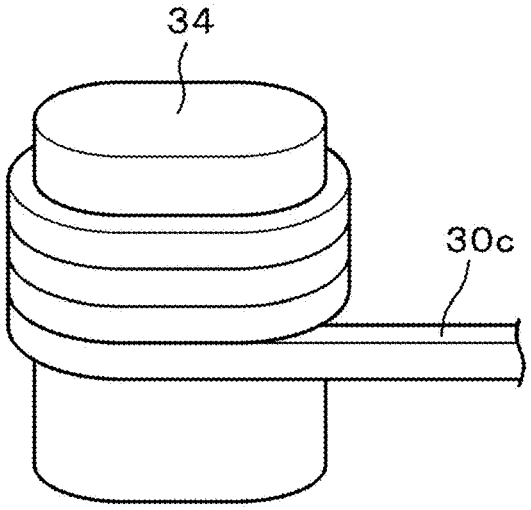
FIG. 6 is a diagram illustrating one phase of the manufacturing process flow of the coil.

Next, as shown in FIG. 6, the surrounded litz wire 30*c* is wound around a winding core material 34 to form the surrounded litz wire 30*c* into a coil shape. The winding core material 34 is formed of wood for example. The surrounded litz wire 30*c* wound around the winding core material 34 in a coil shape is referred to as a coil 10*b* as shown in FIG. 7.

Figure 7:
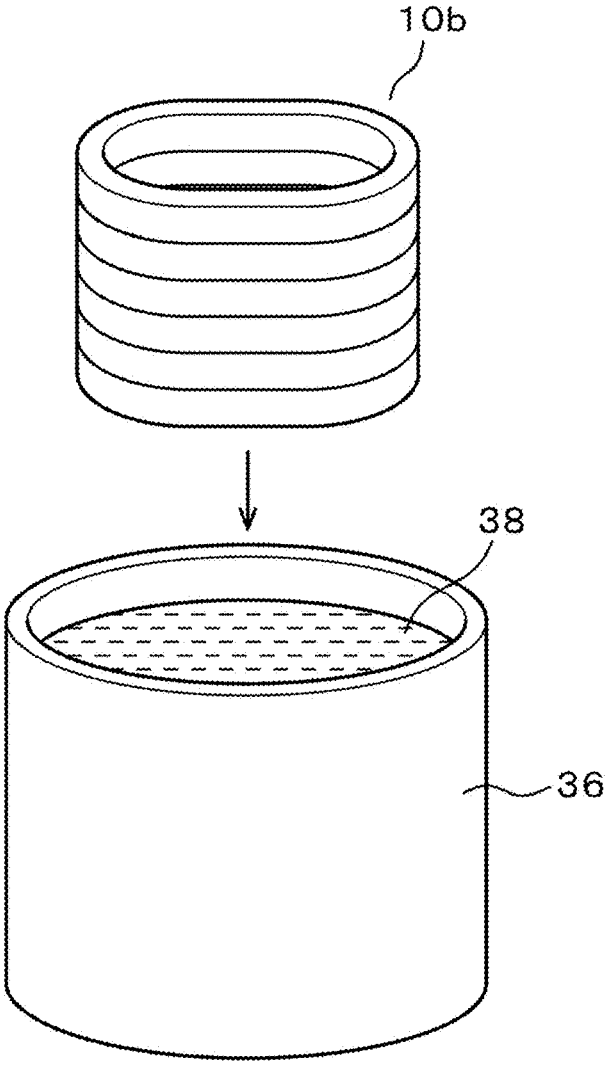
FIG. 7 is a diagram illustrating one phase of the manufacturing process flow of the coil.

After removing the coil 10*b* from the winding core material 34, the coil 10*b* is immersed in a resin container 36 filled with the resin liquid 38 as shown in FIG. 7. The filling of the resin liquid 38 into the coil 10*b* is facilitated by placing the resin container 36 in a space having a pressure lower than the atmospheric pressure. As described earlier, the nonwoven tape 32 allows permeation of the resin liquid 38. Further, the lashing band 22 is wound around the intertwined litz wire 30*a* so as to form gaps between the lashing bands 22 as shown in FIG. 4. Thus, the resin liquid 38 permeates the nonwoven tape 32 to reach into the surrounded litz wire 30*c* and further between the first unit litz wires 16 and between the strands 14 through the gaps G of the wound lashing bands 22. Thus, the resin liquid 38 is filled without leaving any spaces between the first unit litz wires 16 or between the strands 14 in the second unit litz wire 18, and further between the lashing band 22, the nonwoven tape 32, the strands 14, the second unit litz wires 18 and the like.

Figure 8:
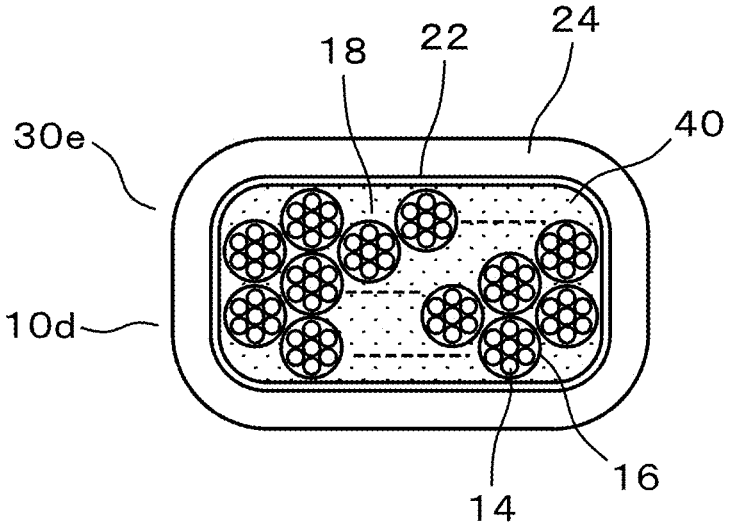
FIG. 8 is a cross sectional view illustrating one phase of the manufacturing process flow of the coil.

As described above, the nonwoven tape 32 includes the hardening accelerator of the resin liquid 38. The coil 10*b* is immersed in the resin liquid 38, and after the resin liquid 38 has permeated sufficiently into the nonwoven tape 32 and the surrounded litz wire 30*c*, the resin liquid 38 in the nonwoven tape 32 hardens through reaction with the hardening accelerator. Thus, the surrounding band 24 hardened by the resin is formed as shown in FIG. 8. Since the hardening accelerator is only contained in the nonwoven tape 32, only the resin liquid 38 at the nonwoven tape 32 portion hardens and the interior resin liquid 38 covered by the nonwoven tape 32 is left unhardened. That is, the inner region covered by the nonwoven tape 32 and located between the first unit litz wires 16 inside the second unit litz wire 18, the strands 14, and the lashing band 22 is filled with the resin liquid 38 prior to being hardened, that is, the unhardened resin 40. The coil in this state is referred to as coil 10*d* and the litz wire constituting the coil 10*d* is referred to as the surrounded litz wire 30*e*. The surrounded litz wire 30*e* constituting the coil 10*d* is configured so that the unhardened resin 40 is filled between the strands 14 and between the first unit litz wires 16 inside the surrounded litz wire 30*e* and the outer periphery of the surrounded litz wire 30*e* is covered by nonwoven tape 32 hardened by the resin liquid 38, that is, the surrounding band 24 as shown in FIG. 8.

Figure 9:
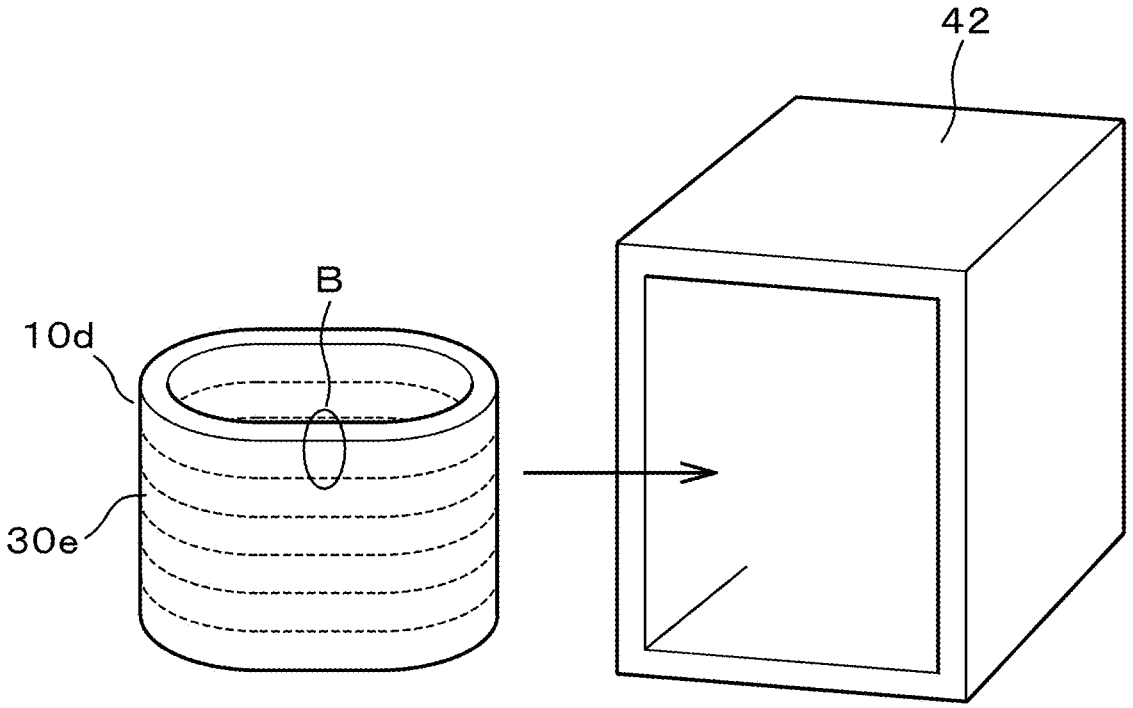
FIG. 9 is a diagram illustrating one phase of the manufacturing process flow of the coil.

Next, the coil 10*d* in the above described state which has been taken out of the resin container 36 is illustrated in FIG. 9. The structure of the surrounded litz wire 30*e* constituting coil 10*d* is illustrated in FIG. 8 as described above. FIG. 8 illustrates the cross sectional structure of portion B of FIG. 9. The periphery of the surrounded litz wire 30*e* constituting the coil 10*d* is covered by the surrounding band 24 hardened by the resin liquid 38 as described above. Thus, even when the coil 10*d* is taken out of the resin container 36, it is possible to prevent the resin liquid 38 inside the coil 10*d*, that is, the unhardened resin 40 from leaking to the exterior and the unhardened resin 40 is held without leaving any spaces in the inside of the coil 10*d* covered by the surrounding band 24.

Next, the coil 10*d* is put into a heat drying furnace 42 as shown in FIG. 9. The entirety of the coil 10*d* is thermally dried by the heat drying furnace 42 to thereby harden the unhardened resin 40 of the coil 10*d*. The hardening of the surrounding band 24 is facilitated at the same time. The coil 10 illustrated in FIG. 1 can be manufactured through the above described process steps.

In the process step illustrated in FIG. 7, the hardening accelerator is contained only in the nonwoven tape 32 portion and the resin liquid 38 of this portion alone is hardened for the following reason. Suppose the hardening accelerator of the resin liquid 38 is not contained in the nonwoven tape 32 portion. In such case, the resin liquid 38 of the nonwoven tape 32 portion is not hardened even in case the coil 10*b* is immersed in the resin liquid 38 inside the resin container 36. When the coil 10 is taken out of the resin container 36 in this state, the unhardened resin 40 inside the coil 10 will leak to the outside by passing through the nonwoven tape 32 since the nonwoven tape 32 allows permeation of the resin liquid. Thus, in case the resin liquid 38 is hardened by the heat drying furnace 42 in this state, the hardened resin 20 is absent in the litz wire 12 constituting the coil 10 and spaces are created between the strands 14, the first unit litz wires 16, the second unit litz wires 18, the lashing band 22, the surrounding band 24, and the like. The insulation property of the coil 10 becomes reduced when such spaces exist.

On the other hand, in order to harden the resin liquid 38 without containing the hardening accelerator in the nonwoven tape 32, the resin liquid is hardened by methods such as applying heat with the coil 10 placed inside the resin container 36. However, when such method is taken, the resin liquid 38 becomes hardened along with the resin container 36 containing the coil 10, thereby causing the coil 10 to be integrated with the resin container 36 and preventing the coil 10 from being taken out of the resin container 36. Further, the hardened resin becomes filled in the cavity in the center of the coil 10 and the cavity becomes blocked by the hardened resin. The hardening accelerator is contained in the nonwoven tape 32 to harden the resin liquid 38 in this portion alone for the above described reasons. That is, the nonwoven tape 32 turns into the surrounding band 24 hardened by the resin by containing the hardening accelerator therein and possesses a function of retaining a state in which the resin liquid 38 is filled inside the coil 10*b* without leaving any spaces when the coil 10*b* is immersed in the resin container 36 filled with the resin liquid 38 and the interior of the coil 10*b* is impregnated with the resin liquid 38. It is thus, possible to obtain coil 10 with improved insulation property without leaving any spaces between the strands 14, the first unit litz wires 16, the second unit litz wires 18, the lashing band 22, and the surrounding band 24 inside the coil 10.

The coil 10 according to the above described embodiment provides the following effects.

In the coil 10 of the embodiment and the litz wire 12 constituting the coil 10, the hardened resin 20 is filled and molded without leaving any spaces between the strands 14 and in the periphery of the strands 14. Thus, the insulation property of the coil 10 is improved to exert excellent insulation property even when the coil 10 is used in high frequency electric appliances for example.

Further, in the coil 10 and the litz wire 12 constituting the coil 10, the strands 14, the first unit litz wires 16, the second unit litz wires 18, the lashing band 22, and the surrounding band 24 are integrally solidified by the hardened resin 20 without leaving any spaces to provide a three-dimensionally secured structure. That is, in the coil 10 and the litz wire 12 constituting the coil 10, the hardened resin 20 is filled, solidified, and molded without leaving any spaces between the strands 14 and in the periphery of the strands 14. Thus, generation of gaps and peeling voids are suppressed in the coil 10 to provide excellent insulation property.

The periphery of the coil 10 and the litz wire 12 constituting the coil 10 of the embodiment are covered by the surrounding band 24 formed of nonwoven tape 32 hardened by the resin. Thus, the insulation property between the litz wires 12 as well as the mechanical strength of the coil 10 are improved.

In the coil 10 and the litz wire 12 constituting the coil 10 of the embodiment, a resin having high thermal conductivity, that is, high heat dissipating property may be employed as the hardened resin 20, that is, the resin liquid 38. In this case, because the coil 10 exhibits excellent heat dissipating property, it is possible to prevent damaging of the coil 10, etc. even when abnormal heat is produced for example at the coil 10.

According to the manufacturing method of the coil 10 of the embodiment, the hardening accelerator of the resin liquid 38 is contained in the nonwoven tape 32. The coil 10*b* being manufactured is immersed in the resin liquid 38, and the resin liquid 38 at the nonwoven tape 32 hardens through reaction with the hardening accelerator after the resin liquid 38 has sufficiently permeated into the surrounded litz wire 30*c*. Thus, the inner region of the coil 10 is filled with resin liquid 38 which is not hardened, that is, the unhardened resin 40 and the outer periphery of the unhardened resin 40 is covered by nonwoven tape 32 hardened by the resin liquid 38, that is, the surrounding band 24. That is, it is possible to create a situation in which the outer periphery of the unhardened resin 40 in the inner region of the coil 10 is covered by the surrounding band 24 solidified by the resin and the unhardened resin 40 is confined therein. It is thus, possible to prevent the unhardened resin 40 in the inner region of the coil 10 from leaking even when the coil 10 being manufactured is taken out of the resin container 36. As a result, it is possible to obtain the coil 10 and the litz wire 12 constituting the coil 10 in which the hardened resin 20 is filled and molded without leaving any spaces between the strands 14 and in the periphery of the strands 14. It is thus, possible to manufacture a coil 10 exhibiting excellent insulation property even when the coil 10 is applied to a high-frequency electric appliance for example.

The above description was given through an example in which a rectangular litz wire was used as the litz wire 12 of the embodiment. However, the litz wire 12 is not limited to a rectangular litz wire. A round litz wire may be used for example.

Second Embodiment

A second embodiment will be described hereinafter with reference to the drawings. In the description of the embodiment, elements that are substantially identical are identified with identical reference symbols and are not re-described.

Figure 10:
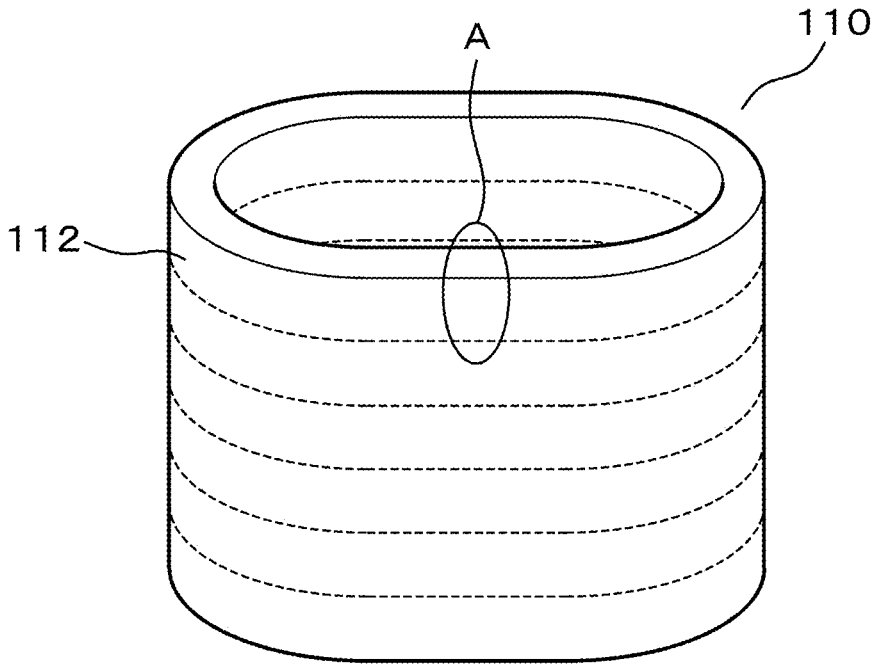
FIG. 10 is a diagram schematically illustrating an exemplary structure of a coil according to a second embodiment.
Figure 11:
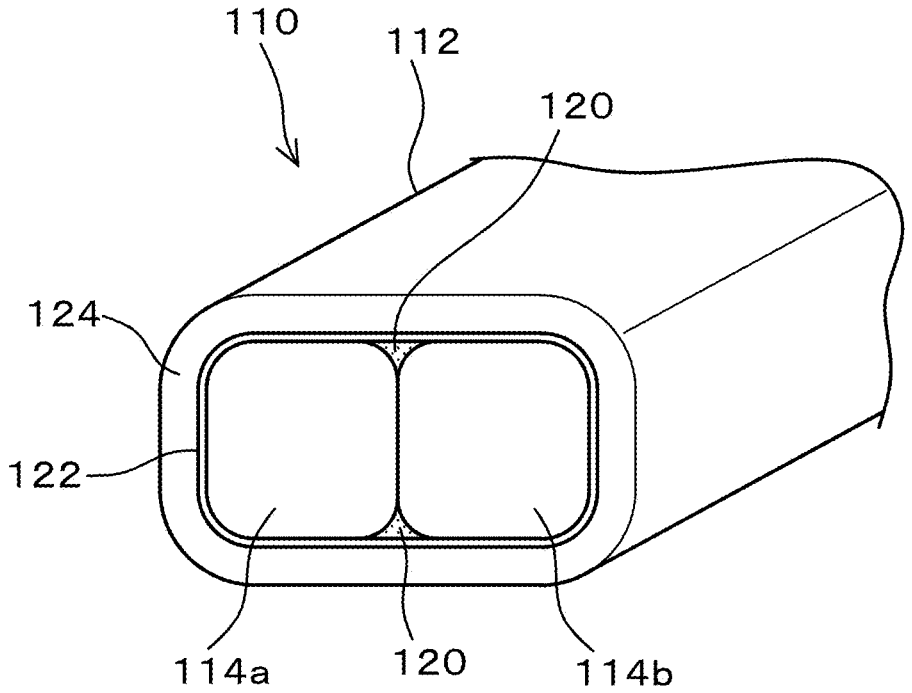
FIG. 11 is a diagram illustrating the cross sectional structure of the coil.

FIG. 10 is a perspective view schematically illustrating an example of a configuration of a coil 110 presented as one example of the embodiment. FIG. 11 is a cross sectional view illustrating portion A of the coil 110 of FIG. 10. Coil 110 is configured by a multiconductor wire 112 formed of copper for example. The coil 110 is configured by tightly winding the multiconductor wire 112 in a whorl so as to form concentric ellipses having a cavity at the center and the entire structure is hardened by a resin. The portion A in FIG. 10 corresponds to a basic unit of the multiconductor wire 112 and FIG. 11 illustrates the basic structure of the multiconductor wire 112 constituting the coil 110. The multiconductor wire 112 used in the coil 110 is a plurality of, for example, two mutually insulated conductive strands 114, for example, a winding conductor formed of a plurality of enamel lines provided with an insulation coating.

As shown in FIG. 11, the multiconductor wire 112 comprises a plurality of strands 114. The periphery of the multiconductor wire 112 is covered by a lashing band 122 and a surrounding band 124.

A strong aramid fiber tape is used for example as the lashing band 122. The lashing band 122 is shaped like a paper tape and is used to lash the strands 114 so that the strands 114 are not disassembled. As shown in the later described FIG. 13 (*a*), the lashing band 122 is wound around the multiconductor wire 112 so as to form gaps G (corresponding to spaces) between the wound lashing bands 122.

The surrounding band 124 is wound around and covers the multiconductor wire 112 lashed by the lashing band 122. The surrounding band 124 is obtained by impregnating a later described nonwoven tape 132 with a later described resin liquid 138 (corresponding to liquid resin) and hardening the resin liquid 138. In this case, the nonwoven tape 132 is given as an example of a material which allows penetration and permeation of the later described resin liquid 138 and which is capable of being wound around the multiconductor wire 112 in the later described manufacturing process flow of the coil 110. The material constituting the surrounding band 124 is not limited to the nonwoven tape 132 as long as it possesses the above described properties.

An insulative hardened resin 120 (resin) exists without leaving any spaces between the plurality of strands 114. Further, the hardened resin 120 exists without leaving any spaces between the strands 114, the lashing band 122, and the surrounding band 124 as well. That is, the entirety of the coil 110 is integrated and secured three-dimensionally by the hardened resin 120 from the inside to the outside. The lashing band 122 and the surrounding band 124 are also solidified without leaving any spaces by the hardened resin 120. That is, the coil 110 and the multiconductor wire 112 constituting the coil 110 are provided with a structure in which the hardened resin 120 is filled and molded without leaving any spaces between the strands 114 and in the periphery of the strands 114.

A resin with high thermal conductivity, that is, high heat dissipating property may be employed as the hardened resin 120, that is, the later described resin liquid 138. A resin obtained by adding a micro-sized and highly thermal conductive filler such as alumina or boron nitride to an epoxy resin for example as an additive that imparts high thermal conductivity is used as a resin having high thermal conductivity. When employing a resin having a high thermal conductivity, the coil 110 and the multiconductor wire 112 constituting the coil 110 are configured so that hardened resin 120 having high thermal conductivity, that is, high heat dissipating property is filled between the plurality of strands 114, between the strands 114, the lashing band 122, and the surrounding band 124, and further to the outer peripheral surface of the coil 110. Thus, the inside of the formed coil 110 and the multiconductor wire 112 constituting the coil 110 are filled with the hardened resin 120 having high thermal conductivity, that is, high heat dissipating property without leaving any spaces, and the outer periphery of the formed coil 110 and the multiconductor wire 112 constituting the coil 110 are covered by the surrounding band 124 hardened by the hardened resin 120 having high heat dissipating property and thus, the entire coil 110 exhibits high thermal conductivity and high heat dissipation property.

Further, because there is very little amount of voids which are prone to become insulation defects and adhesion of the conductor portion and the resin is good, it is possible to obtain high insulation performance.

Figure 12:
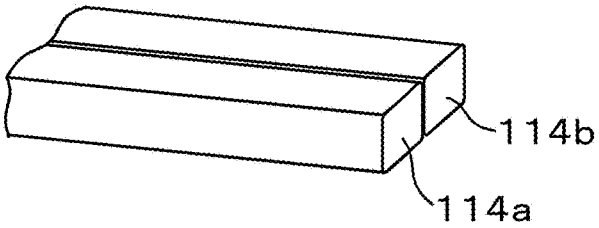
FIG. 12 is a diagram illustrating one phase of the manufacturing process flow of the coil.
Figure 13:
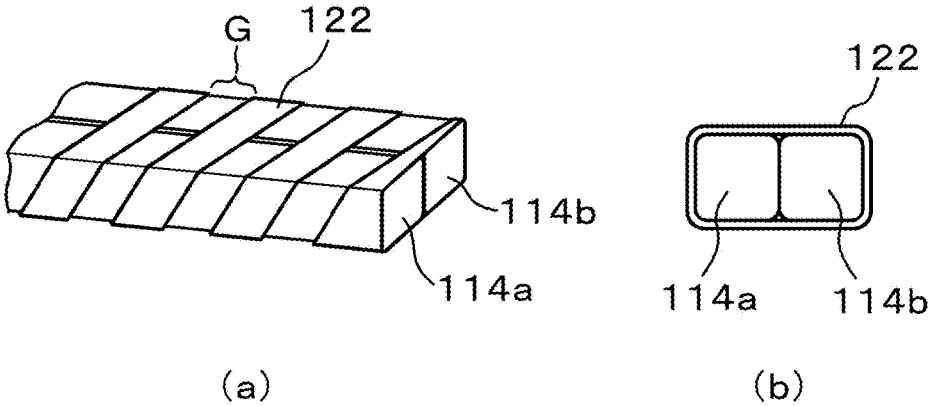
FIG. 13 is a diagram illustrating one phase of the manufacturing process flow of the coil.
Figure 14:
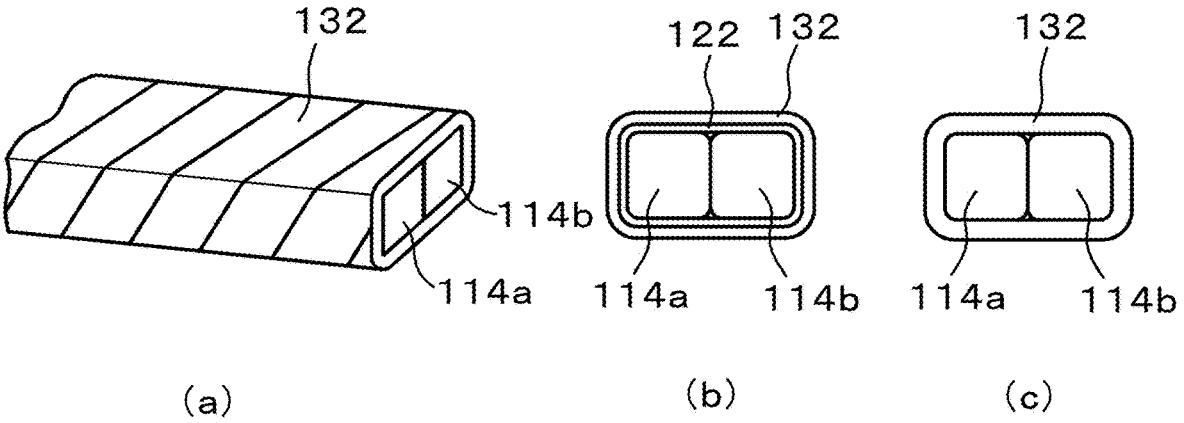
FIG. 14 is a diagram illustrating one phase of the manufacturing process flow of the coil.

Next, a description will be given on the method of manufacturing the coil 110. FIGS. 12 to 18 are diagrams for explaining the manufacturing method of the coil 110 and each indicate one phase of the manufacturing process flow. FIG. 12 indicates one phase of the manufacturing process flow of the multiconductor wire 112 constituting the coil 110. FIG. 13 indicates one phase of the manufacturing process flow of the multiconductor wire 112 constituting the coil 110 and FIG. 13 (*a*) is a perspective view and FIG. 13 (*b*) is a cross sectional view. FIG. 14 indicates one phase of the manufacturing process flow of the multiconductor wire 112 constituting the coil 110 and FIG. 14 (*a*) is a perspective view, and FIGS. 14 (*b*) and 14 (*c*) are cross sectional views.

First, a plurality of strands 114 are prepared as illustrated in FIG. 12. In FIG. 12, two strands 114 are illustrated, namely a strand 114*a* and a strand 114*b*.

Next, as shown in FIGS. 13 (*a*) and 13 (*b*), the strands 114 are lashed by winding the lashing band 122 around the strands 114 to form the multiconductor wire 112. The lashing band 122 is wound so as to form gaps, that is, spaces. In this state, the strands 114 are exposed from the gaps between the wound lashing bands 122. Because the lashing band 122 is an aramid paper tape for example, the later described resin liquid is not allowed to permeate therethrough. That is, the lashing band 122 does not allow permeation of the unhardened resin liquid.

Then, as shown in FIGS. 14 (*a*) and 14 (*b*), the nonwoven tape 132 is wound around a lashing line 130*b*. In this case, the nonwoven tape 132 is wound around the lashing line 130*b* so as not to form any gaps between the wound nonwoven tapes 132. The nonwoven tape 132 allows penetration and permeation of the later described resin liquid 138.

The nonwoven tape 132 includes a hardening accelerator (corresponds to a resin hardening accelerator) of the later described resin liquid 138. Amines, imidazoles, phosphine, DBU (1,8-diazabicyclo[5.4.0]undec-7-ene) and its organic acid salt, ammonium or phosphonium compound or the like are used as the hardening accelerator.

In case the nonwoven tape 132 is strong enough to lash the strands 114, that is, strong enough to prevent the strands 114 from disassembling, it is possible to omit the lashing of the strands 114 by the lashing band 122. That is, as shown in FIGS. 14 (*a*) and 14 (*b*), it is possible to form the multiconductor wire 112 shown in FIG. 14 (*c*) by winding the nonwoven tape 132 around the strands 114 without leaving any spaces. In this case, it is possible to omit the lashing by the lashing band 122 and thus, simplifies the process flow to contribute in reduction of manufacturing cost. Further, in the coil 110 and the multiconductive wire 112 constituting the coil 110 in this case, the periphery of the strands 114 is covered by the surrounding band 124. The remaining structures are the same.

Figure 15:
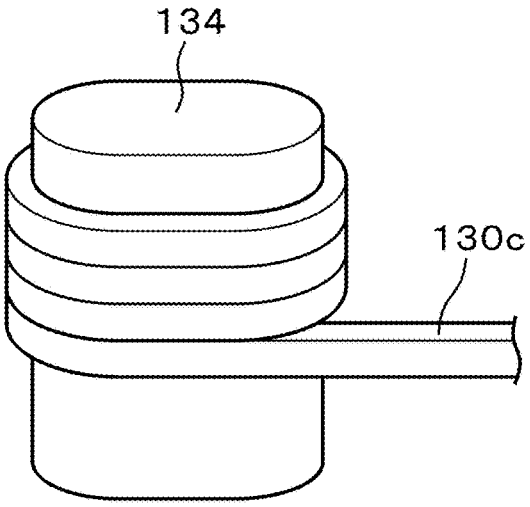
FIG. 15 is a diagram illustrating one phase of the manufacturing process flow of the coil.

Next, as shown in FIG. 15, the multiconductor wire 112 is spirally wound around a winding core material 134 to form the multiconductor wire 112 in a coil shape. The winding core material 34 is made of wood for example. The multiconductor wire 112 wound around the winding core material 134 in a coil shape is referred to as a coil 110*b* as shown in FIG. 16

Figure 16:
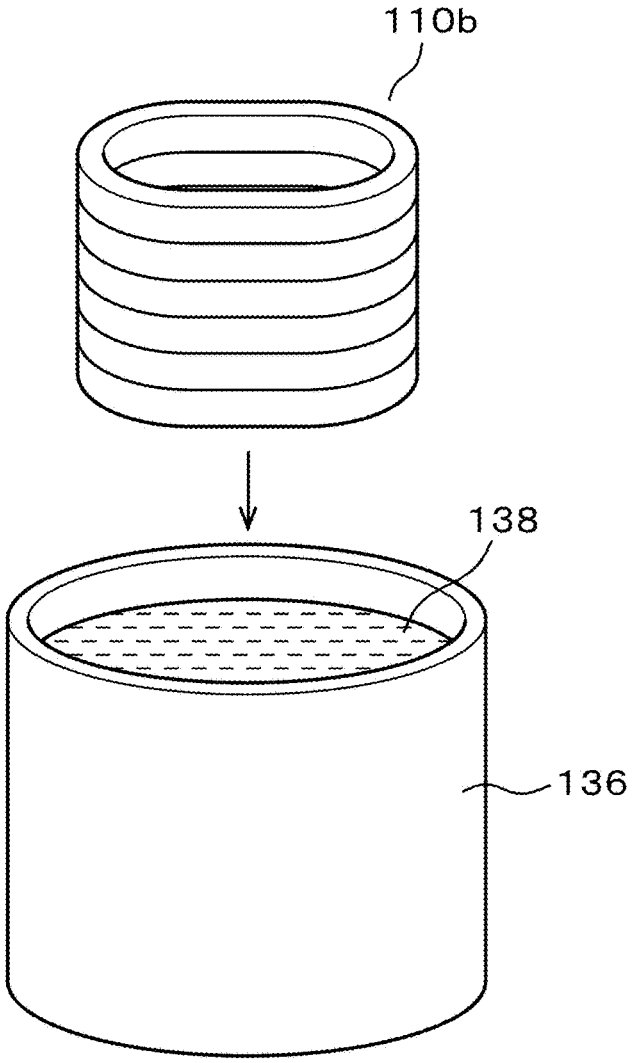
FIG. 16 is a diagram illustrating one phase of the manufacturing process flow of the coil.

After removing the coil 110*b* from the winding core material 134, the coil 110*b* is immersed in a resin container 136 filled with the resin liquid 138 as shown in FIG. 16. The filling of the resin liquid 138 into the coil 110*b* is facilitated by placing the resin container 136 in a space having a pressure lower than the atmospheric pressure. As described earlier, the nonwoven tape 132 allows permeation of the resin liquid 138. Further, the lashing band 122 is wound around the strands 114 so as to form gaps G between the lashing bands 122 as shown in FIG. 13. Thus, the resin liquid 138 permeates the nonwoven tape 132 to reach the outer peripheral surface (surface) of the strands 114 and further between the strands 114 through the gaps G of the wound lashing bands 122. Thus, resin liquid 138 is filled without leaving any spaces between the strands 114 and further between the lashing band 122, the nonwoven tape 132, and the strands 114.

Figure 17:
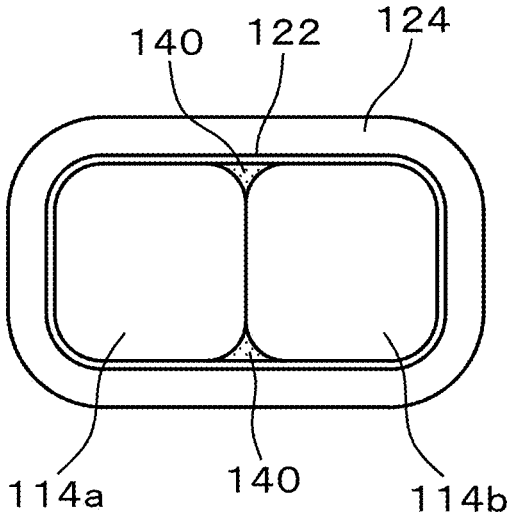
FIG. 17 is a cross sectional view illustrating one phase of the manufacturing process flow of the coil.

As described above, the nonwoven tape 132 includes the hardening accelerator of the resin liquid 138. The coil 110*b* is immersed in the resin liquid 138, and after the resin liquid 138 has permeated sufficiently into the nonwoven tape 132 and the multiconductor wire 112, the resin liquid 138 in the nonwoven tape 132 hardens through reaction with the hardening accelerator. Thus, the surrounding band 124 hardened by the resin is formed as shown in the later described FIG. 17. Since the hardening accelerator is only contained in the nonwoven tape 132, only the resin liquid 138 of the nonwoven tape 132 portion hardens and the interior resin liquid 138 covered by the nonwoven tape 132 is left unhardened. That is, the inner region covered by the nonwoven tape 132 and located between the strands 114 and the lashing band 122 is filled with the resin liquid 138 prior to being hardened, that is, the unhardened resin 140. When the coil in this state is referred to as coil 110*d*, the multiconductor wire 112 constituting the coil 110*d* is configured so that the unhardened resin 140 is filled between the strands 114 inside the multiconductor wire 112 and the outer periphery of the multiconductor wire 112 is covered by the nonwoven tape 132 hardened by the resin liquid 138, that is, the surrounding band 124 as shown in FIG. 17.

Figure 18:
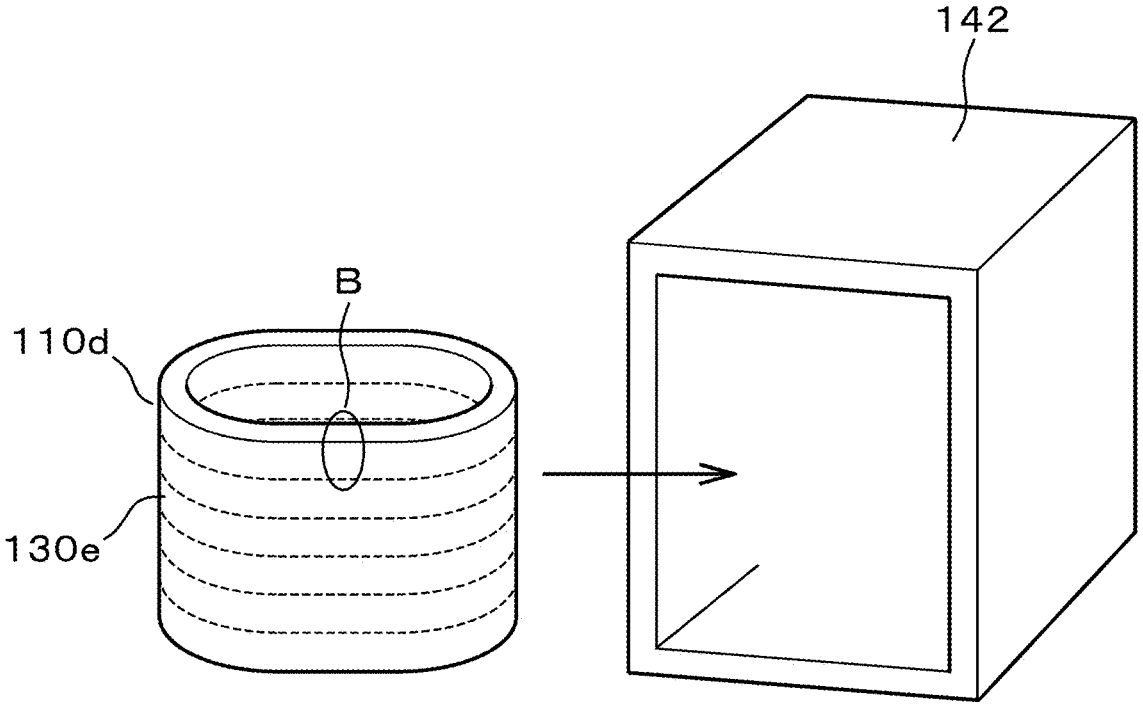
FIG. 18 is a diagram illustrating one phase of the manufacturing process flow of the coil.

Next, the coil 110*d* in the above described state which has been taken out of the resin container 136 is illustrated in FIG. 18. The structure of the multiconductor wire 112 constituting the coil 110*d* is illustrated in FIG. 17 as described above. FIG. 17 illustrates the cross sectional structure of portion B of FIG. 18. The periphery of the multiconductor wire 112 constituting the coil 110*d* is covered by the surrounding band 124 hardened by the resin liquid 138. Thus, even when the coil 110*d* is taken out of the resin container 136, it is possible to prevent the resin liquid 138 inside the coil 110*d*, that is, the unhardened resin 140 from leaking to the exterior and the unhardened resin 140 is held without leaving any spaces in the inside of the coil 110*d* covered by the surrounding band 124.

Next, the coil 110*d* is put into a heat drying furnace 142 as shown in FIG. 18. The entirety of the coil 110*d* is thermally dried by the heat drying furnace 142 to thereby harden the unhardened resin 140 of the coil 110*d*. The hardening of the surrounding band 124 is facilitated at the same time. The coil 110 illustrated in FIG. 10 can be manufactured through the above described process steps.

In the process step illustrated in FIG. 16, the hardening accelerator is contained only in the nonwoven tape 132 portion and the resin liquid 138 of this portion alone is hardened for the following reason. Suppose the hardening accelerator of the resin liquid 138 is not contained in the nonwoven tape 132 portion. In such case, the resin liquid 138 of the nonwoven tape 132 portion is not hardened even in case the coil 110*b* is immersed in the resin liquid 138 inside the resin container 136. When the coil 110 is taken out of the resin container 136 in this state, the unhardened resin 140 inside the coil 110 will leak to the outside by passing through the nonwoven tape 132 since the nonwoven tape 132 allows permeation of the resin liquid 138. Thus, in case the resin liquid 138 is hardened by the heat drying furnace 142 in this state, the hardened resin 120 is absent in the multiconductor wire 112 constituting the coil 110 and spaces are created between the strands 114, the lashing band 122, the surrounding band 124, and the like. The insulation property of the coil 110 becomes reduced when such spaces exist.

On the other hand, in order to harden the resin liquid 138 without containing the hardening accelerator in the nonwoven tape 132, the resin liquid 138 is hardened by methods such as applying heat with the coil 110 placed inside the resin container 136. However, when such method is taken, the resin liquid 138 becomes hardened along with the resin container 136 containing the coil 110, thereby causing the coil 110 to be integrated with the resin container 136 and preventing the coil 110 from being taken out of the resin container 136. Further, the hardened resin becomes filled in the cavity in the center of the coil 110 and the cavity becomes blocked by the hardened resin. The hardening accelerator is contained in the nonwoven tape 132 to harden the resin liquid 138 in this portion alone for the above described reasons. That is, the nonwoven tape 132 turns into the surrounding band 124 hardened by the resin by containing hardening accelerator in the nonwoven tape 132 and possesses a function of retaining a state in which the resin liquid 138 is filled inside the coil 110*b* without leaving any spaces when the coil 110*b* is immersed in the resin container 136 filled with the resin liquid 138 and the interior of the coil 110*b* is impregnated with the resin liquid 138. It is thus, possible to obtain coil 110 with improved insulation property without leaving any spaces between the strands 114, the lashing bands 122, and the surrounding bands 124 inside the coil 110.

The coil 110 according to the above described embodiment provides the following effects.

In the coil 110 and the multiconductor wire 112 constituting the coil 110 of the embodiment, hardened resin 120 is filled and molded between the strands 14 and in the periphery of the strands 14 without leaving any spaces. Thus, the insulation property of the coil 110 is improved and excellent insulation property is exerted even when the coil 110 is used in a high-frequency electric appliances for example.

Further, in the coil 110 and the multiconductor wire 112 constituting the coil 110, the strands 114, the lashing band 122, and the surrounding band 124 are integrally solidified by the hardened resin 120 without leaving any spaces to provide a three-dimensionally secured structure. That is, in the coil 110 and the multiconductor wire 112 constituting the coil 110, the hardened resin 120 is filled, solidified, and molded between the strands 114 and in the periphery of the strands 114 without leaving any spaces. Thus, generation of gaps and peeling voids are suppressed in the coil 110 to provide excellent insulation property.

The periphery of the coil 110 and the multiconductor wire 112 constituting the coil 110 of the embodiment are covered by the surrounding band 124 formed of the nonwoven tape 132 hardened by the resin. Thus, the insulation property between the multiconductor wires 112 as well as the mechanical strength of the coil 110 are improved.

In the coil 110 and the multiconductor wire 112 constituting the coil 110 of the embodiment, a resin having high thermal conductivity, that is, high heat dissipating property may be employed as the hardened resin 120, that is, the resin liquid 138. In this case, because the coil 110 exhibits excellent heat dissipating property, it is possible to prevent damaging of the coil 110, etc. even when abnormal heat is produced for example at the coil 110.

According to the manufacturing method of the coil 110 of the embodiment, the hardening accelerator of the resin liquid 138 is contained in the nonwoven tape 132. The coil 110*b* being manufactured is immersed in the resin liquid 138 and the resin liquid 138 at the nonwoven tape 132 hardens through reaction with the hardening accelerator after the resin liquid 138 has sufficiently permeated into the multiconductor wire 112. Thus, the inner region of the coil 110 is filled with resin liquid 138 which is not hardened, that is, the unhardened resin 140 and the periphery of the unhardened resin 140 is covered by nonwoven tape 132 hardened by the resin liquid 138, that is, the surrounding band 124. That is, it is possible to create a situation in which the periphery of the unhardened resin 140 in the inner region of the coil 110 is covered by the surrounding band 124 solidified by the resin and the unhardened resin 140 is confined therein. It is thus, possible to prevent the unhardened resin 140 of the inner region of the coil 110 from leaking even when the coil 110 being manufactured is taken out of the resin container 136. As a result, it is possible to obtain the coil 110 and the multiconductor wire 112 constituting the coil 10 in which the hardened resin 120 is filled and molded without leaving any spaces between the strands 114 and in the periphery of the strands 114. It is thus, possible to manufacture a coil 110 having excellent insulation property.

Figure 19:
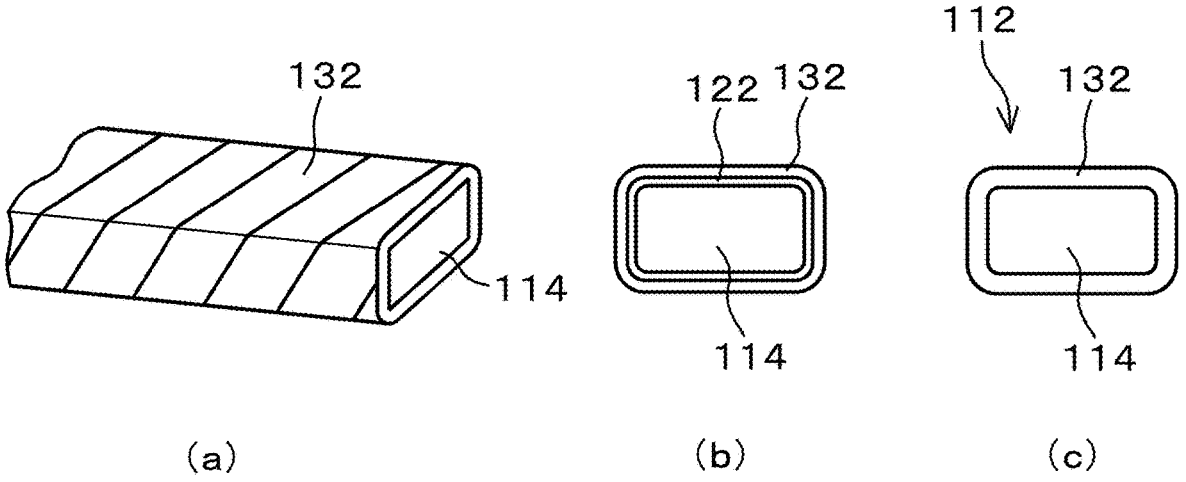
FIG. 19 is a diagram schematically illustrating an exemplary structure of another coil.

The foregoing embodiment described an example in which a rectangular line having a substantially rectangular cross section obtained by bundling two strands 114*a* and 114*b* was used, however, a single strand 114 having a substantially rectangular cross section may be used as shown in FIG. 19 (*a*). Even when such strand 114 is used, the resin liquid 138 permeates to the surface of the strand 114 as illustrated in FIG. 19 (*b*) by winding the nonwoven tape 132 around the strand 114 and immersing the strand 114 in the resin container 136 as was the case in the embodiment. Then, by thermally treating the strand 114, it is possible to obtain the multiconductor wire 112 with excellent insulation property as shown in FIG. 19 (*c*). It is thus, possible to manufacture the coil 110 having excellent insulation property.

The above description was given through an example in which a rectangular wire having a rectangular cross section was used as the multiconductor wire 112 in the embodiment. However, multiconductor wire 112 is not limited to a rectangular wire. A round wire having a circular cross section for example may be used instead.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. A winding conductor formed by molding a bundle of conductive thin wires by a resin, wherein:

a tape that does not allow a liquid resin to permeate therethrough is contacting to and wound around the winding conductor while forming gaps;

a peripheral surface of the tape as well as a peripheral surface of the winding conductor are covered by a non-woven cloth hardened by the resin;

the resin fills surfaces of the thin wires without leaving any spaces; and the winding conductor is formed into a whorl having a cavity at a center with an entire structure of the winding conductor being hardened by the resin.

2. The winding conductor according to claim 1, wherein the resin exhibits high thermal conductive property.

3. The winding conductor according to claim 1, wherein the resin has an additive imparting high thermal conductive property added thereto.

* * * * *